US007806786B2

(12) United States Patent
Joffe

(10) Patent No.: US 7,806,786 B2
(45) Date of Patent: Oct. 5, 2010

(54) GOLF TEE HEIGHT STOPPER

(76) Inventor: Scott M. Joffe, 1008 Wild Basin Ledge, Austin, TX (US) 78746

( * ) Notice: Subject to any disclaimer, the term of this patent is extended or adjusted under 35 U.S.C. 154(b) by 55 days.

(21) Appl. No.: 12/080,697

(22) Filed: Apr. 4, 2008

(65) Prior Publication Data

US 2008/0188328 A1 Aug. 7, 2008

Related U.S. Application Data

(63) Continuation-in-part of application No. 11/473,927, filed on Jun. 23, 2006, now abandoned, and a continuation-in-part of application No. PCT/US2007/014652, filed on Jun. 22, 2007.

(51) Int. Cl.
*A63B 57/00* (2006.01)

(52) U.S. Cl. ..... 473/386; 473/400

(58) Field of Classification Search ..... 473/386–403; D21/717–719

See application file for complete search history.

(56) References Cited

U.S. PATENT DOCUMENTS

| | | | | | |
|---|---|---|---|---|---|
| 1,616,059 | A * | 2/1927 | Mulvehill | 473/398 |
| 1,625,911 | A * | 4/1927 | Richards | 473/398 |
| 1,936,625 | A * | 11/1933 | Goldman | 473/398 |
| 2,661,213 | A * | 12/1953 | Barnard | 473/394 |
| 3,114,557 | A * | 12/1963 | Cabot | 473/398 |
| 3,203,700 | A * | 8/1965 | Antonious | 473/398 |
| 3,347,551 | A * | 10/1967 | Dreyfus | 473/396 |
| 3,408,079 | A * | 10/1968 | Kirikos | 473/398 |
| 4,982,510 | A * | 1/1991 | Musillo | 473/386 |
| 5,645,500 | A * | 7/1997 | Borden | 473/408 |
| 5,672,122 | A * | 9/1997 | Strong | 473/398 |
| 6,475,107 | B1 * | 11/2002 | Sand | 473/398 |
| 6,769,999 | B1 * | 8/2004 | Chase | 473/386 |
| 7,044,866 | B1 * | 5/2006 | Blauvelt | 473/386 |
| 2005/0026726 | A1 * | 2/2005 | Barouh | 473/398 |
| 2006/0166765 | A1 * | 7/2006 | Holtzman | 473/387 |
| 2006/0199669 | A1 * | 9/2006 | Barouh | 473/398 |

FOREIGN PATENT DOCUMENTS

| | | | |
|---|---|---|---|
| JP | 07031700 | A * | 2/1995 |
| JP | 2004321437 | A * | 11/2004 |
| JP | 2005224579 | A * | 8/2005 |
| JP | 2007111505 | A * | 5/2007 |
| WO | WO 9423806 | A1 * | 10/1994 |

* cited by examiner

*Primary Examiner*—Steven Wong
(74) *Attorney, Agent, or Firm*—Douglas E. Warren

(57) ABSTRACT

A golf tee stopper having a center aperture of material and design so as to slide over a golf tee while creating enough friction with the tee to act as a stop against the ground when teeing a golf ball using the method as described herein and providing the capability to repeatedly insert a golf tee to essentially the same depth to thereby allow the golf tee to hold a golf ball at a height preferred by a user. A set of calibration indicia on the golf tee stopper can be used to mark a golf tee in a manner that assists in the repeatable placement of the golf tee at a substantially consistent height.

6 Claims, 3 Drawing Sheets

GOLF TEE HEIGHT STOPPER

CROSS REFERENCE TO RELATED APPLICATIONS

This application is a continuation-in-part application of United States nonprovisional patent application Ser. No. 11/473,927 filed Jun. 23, 2006 now abandoned, and PCT Application Number PCT/US2007/014652 filed Jun. 22, 2007. Both of those applications are incorporated by reference in their entirety into this present application as if fully stated herein, and for all applicable purposes.

STATEMENT REGARDING FEDERALLY SPONSORED RESEARCH

Not Applicable.

BACKGROUND OF THE INVENTION

This invention relates to a device used in the sport of golf, and more specifically to a device that attaches to any typical golf tee and acts as a stopping mechanism to set a consistent, repeatable teed ball height.

Golf is a game of precision, with many variables affecting a golfer's performance. The elimination of any one variable would presumably lead to greater enjoyment of the game. At the start of every hole a golfer may choose to place his/her ball on a tee, which is designed to hold the ball a certain distance above the ground so as to promote cleaner contact with the club head and more desired distance and direction. Golf tees are ubiquitous, and manufactured to various heights and thicknesses, as well as out of a variety of materials (wood dominates), and with a variety of finishes (paint dominates). Due to the unique nature of individual golfers and the variety of club designs available, for each golfer the exact preferred height varies, but for each golfer it is desirable for the teed ball height to be consistent from hole to hole when the golfer is using the same club.

The prior attempts at providing a means to ensure consistent, repeatable teed ball height can be grouped in several groupings. The first group is specially designed golf tees with accompanying stoppers, which only work with that particular tee. Examples of this grouping are U.S. Pat. No. 1,625,911 (Apr. 26, 1927) to Richards, U.S. Pat. No. 3,114,557 (Dec. 17, 1963) to Cabot, U.S. Pat. No. 3,203,700 (Aug. 31, 1965) to Antonious, U.S. Pat. No. 3,408,079 (Oct. 29, 1968) to Kirikos, Des. 370,041 (May 21, 1996) to Thomas, U.S. Pat. No. 5,571,055 (Nov. 5, 1996) to Lewis et al., U.S. Pat. No. 5,672,122 (Sep. 30, 1997) to Strong, Des. 413,640 (Sep. 7, 1999) to Fearer, III, U.S. Pat. No. 6,475,107 B1 (Nov. 5, 2002) to Sand, U. S. Pat. No. 6,729,977 B1 (May 4, 2004) to Young et al., and 2005/0026726 A1 (Feb. 3, 2005) to Barouh. These prior inventions are not designed to work with a standard, typical golf tee. As typical golf tees are readily available and provided for free or at a very low cost, the best solution for this problem of consistent, repeatable teed ball height is a device that works will all typical tees universally.

The second group of prior attempts at providing a means to ensure consistent, repeatable teed ball height includes tee-setting gauges with predetermined, specific height options. Examples of this grouping are U.S. Pat. No. 4,896,883 (Jan. 30, 1990) to Wagenknecht, U.S. Pat. No. 4,982,510 (Jan. 8, 1991) to Musillo, U.S. Pat. No. 5,370,388 (Dec. 6, 1994) to Wehner, and U.S. Pat. No. 5,735,758 (Apr. 7, 1998) to Miketinac. These prior inventions limit the user to the specific, gauge-defined height options which may or may not be the exact height that particular user requires.

The third group of prior attempts at providing a means to ensure consistent, repeatable teed ball height includes tee sets with a variety of heights and/or the ability to combine parts to create a variety of heights. Examples of these types of systems are U.S. Pat. No. 6,186,907 (Feb. 13, 2001) to Woodward, and U.S. Pat. 6,267,235 (Jul. 31, 2001) to Matias and Matias. These prior inventions carry both shortcomings identified for groups one and two—they limit the user to the specific heights provided by the set and also require the user to procure their non-standard teeing system, precluding the use of typical, ubiquitous golf tees in achieving consistent, repeatable teed ball height.

A final example of a prior attempt at providing a means to ensure consistent, repeatable teed ball height is U.S. Pat. No. 5,890,976 (Apr. 6, 1999) to Anderson. This device provides a means for identifying the preferred tee depth, but does not provide a positive stop for the teeing process. Additionally, with this device the user is required to discern, by looking at ground level, through blades of grass, when the line indicating the desired teed depth is in proper relation to the ground.

As evidenced here, the above attempts to provide a repeatable teed ball height do not provide a stopping function combined with the ability to be used with a typical golf tee.

SUMMARY OF THE INVENTION

In accordance with preferred embodiments of the present invention, a stopper, having a center aperture designed so as to slide over any size, typical golf tee while creating enough friction with the tee so as to act as a consistent, repeatable stop against the ground when teeing a golf ball in the manner described herein. Embodiments of the invention can include a calibration device that provides a method of marking golf tees in a manner that further aids in the placement of a golf tee at a repeatable height.

DESCRIPTION OF THE DRAWINGS

In the accompanying drawings which form part of the specification.

Corresponding reference numerals indicate corresponding steps or parts throughout the several figures of the drawings.

Figure 1:
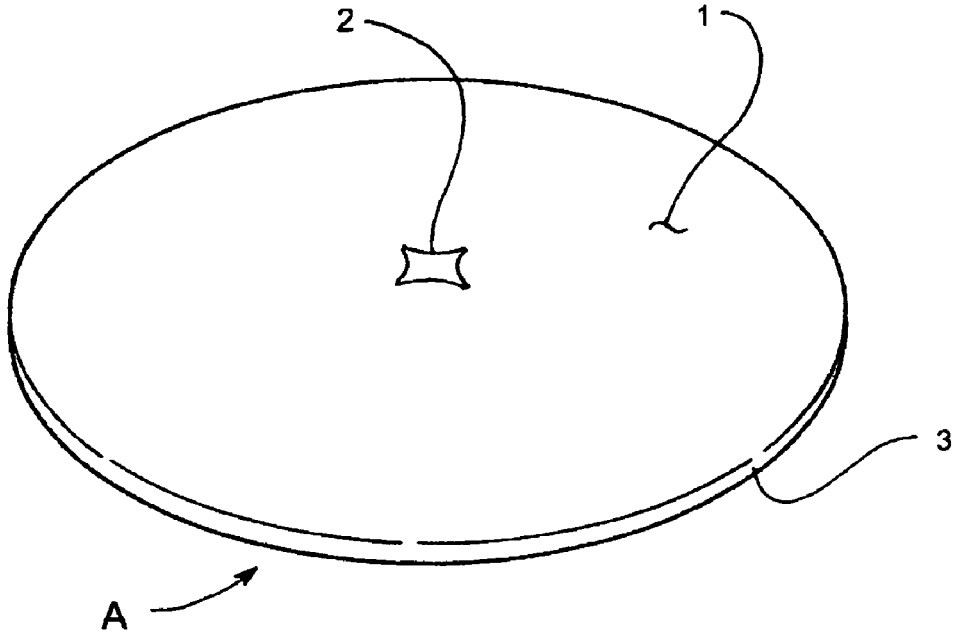
FIG. 1 shows a top perspective view of one embodiment of the present invention.
Figure 2:
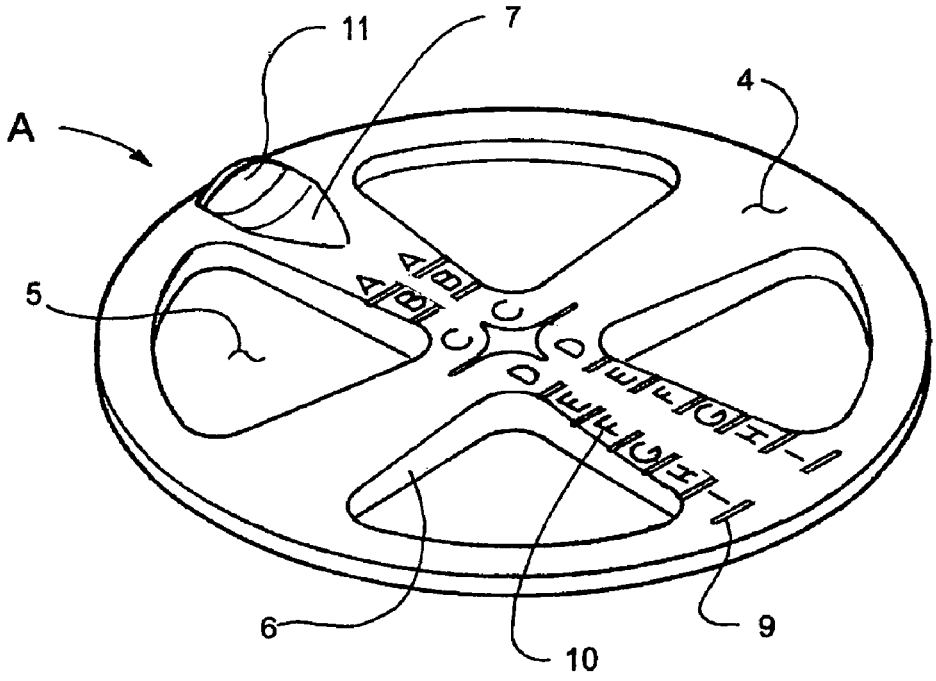
FIG. 2 shows a bottom perspective view of one embodiment of the present invention.
Figure 3:
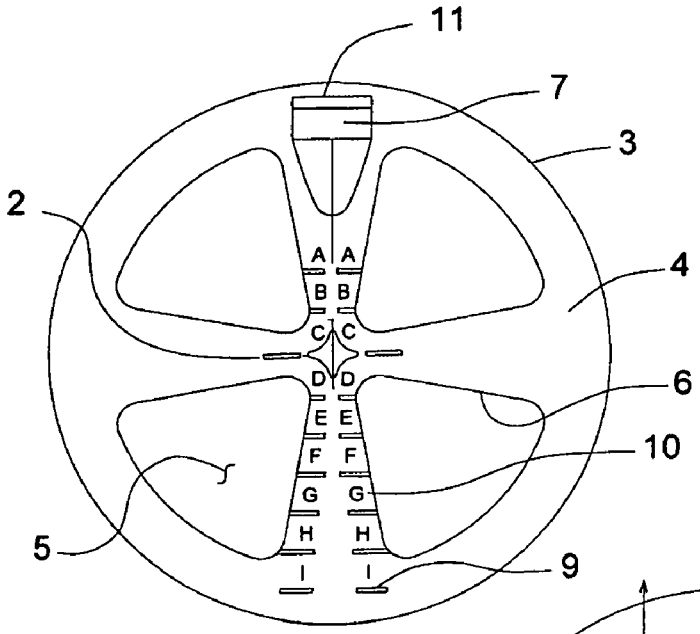
FIG. 3 shows a plan view of one embodiment of the present invention.
Figure 4:
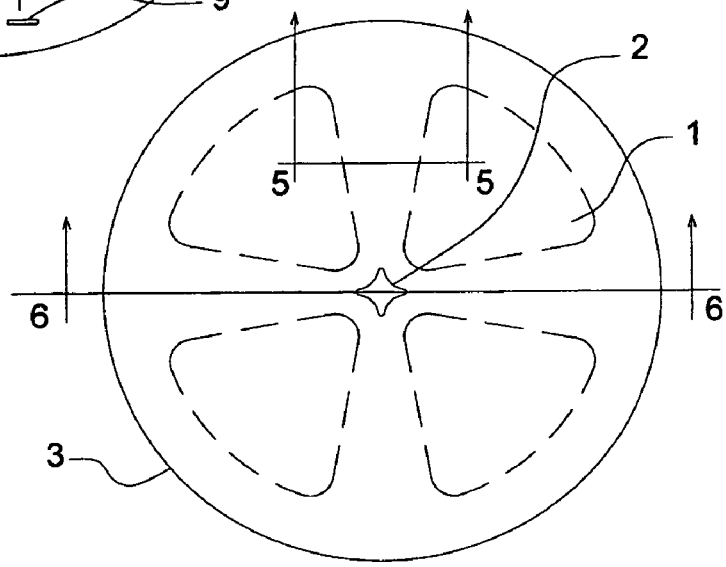
FIG. 4 shows a bottom view of one embodiment of the present invention.
Figure 5:
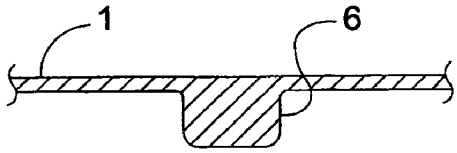
FIG. 5 shows a partial vertical section view of one portion of one embodiment of the present invention.

While one embodiment of the present invention is illustrated in the above referenced drawings and in the following description, it is understood that the embodiment shown is merely one example of a single preferred embodiment offered for the purpose of illustration only and that various changes in construction may be resorted to in the course of manufacture in order that the present invention may be utilized to the best advantage according to circumstances which may arise, without in any way departing from the spirit and intention of the present invention, which is to be limited only in accordance with the claims contained herein.

DETAILED DESCRIPTION OF AT LEAST ONE EMBODIMENT OF THE INVENTION

A preferred embodiment of the golf tee height stopper A of the present invention is illustrated in FIG. 1 through FIG. 7. In this embodiment, the golf tee height stopper A includes a top portion 1, an aperture 2, an edge 3, a bottom surface 4, an inner bottom surface 5, a plurality of spokes 6, an indentation 7, a set of linear marking indicia 9, and a set of sequential marking indicia 10.

A preferred embodiment of the golf tee height stopper A includes the top portion 1 (FIG. 1) that is generally circular in shape and which covers substantially all of the top surface of the golf tee height stopper A. The aperture 2 is located at about the center of the golf tee height stopper A. In the present embodiment, the aperture 2 is in the general shape of a square where the adjacent corners of the square are about 0.09 inches apart. More specifically, as shown in FIG. 1, the aperture 2 in a preferred embodiment is in the general shape of a square having each of the four sides of the square arcuately shaped inwardly toward the center of the square. The curved nature of the sides of the square in the aperture 2 provide additional gripping action between the inside surfaces of the aperture and the surface of the shaft of the golf tee. The gripping action is accomplished in certain embodiments of the invention when the distance between the concave inside surfaces of the aperture 2 is less than the diameter of the shaft of the golf tee. As such, the concave inside surfaces of the aperture 2 are either deformed to some extent when the shaft of the golf tee is inserted into the aperture, or the concave insides surfaces of the aperture are slightly dislocated when the shaft of the golf tee is inserted into the aperture. Because the material used to make the golf tee height stopper A in a preferred embodiment is generally resilient, the resiliency of the material tends to bias the deformed or dislocated concave inside surfaces of the aperture 2 toward the shaft of the inserted golf tee. That bias acts to enhance the grip of the aperture 2 on the golf tee when the tee is inserted into the golf tee height stopper A.

In yet other embodiments of the present invention, the aperture 2 can be in other shapes such as polygons, triangles, circles, and ellipses. In fact, it will be appreciated by those of skill in the art that the aperture 2 can be of any symmetric or asymmetric shape as long as the shape and size of the shape selected are capable of sufficiently holding the shaft of a standard golf tee within the aperture 2 to allow the golf tee height stopper A to function as described herein. It is also understood that the type of material used to make the golf tee height stopper A may also have an effect on the size and shape of the aperture 2. Thus, the final size and shape of the aperture 2 of any embodiment may be dependent on the type of material used and the amount of grip and friction desired between the golf tee height stopper A and the golf tee being inserted into the golf tee height stopper A.

In present preferred embodiment, the golf tee height stopper A is made from a resilient material such an elastomeric polymer, urethane, or rubber. It will be appreciated by those skilled in the art that the golf tee height stopper A can also be fabricated from any material having the proper density, durometer, and memory to create the friction needed to maintain it's location on a tee, while at the same time being stiff enough to act as a stop against the ground during the teeing process.

The golf tee height stopper A has a plurality of spokes 6 (FIG. 2 and FIG. 3) that generally radiate from the center of the golf tee height stopper A to the edge 3. The thickness of each of the plurality of spokes 6 (FIG. 5) in the present embodiment is greater at the center of the golf tee height stopper A than at the edge 3. The top portion 1 (FIG. 1 and FIG. 4) of the present embodiment of the golf tee height stopper A has a diameter of between about 2 inches and about 2⅛ inches.

Figure 6:
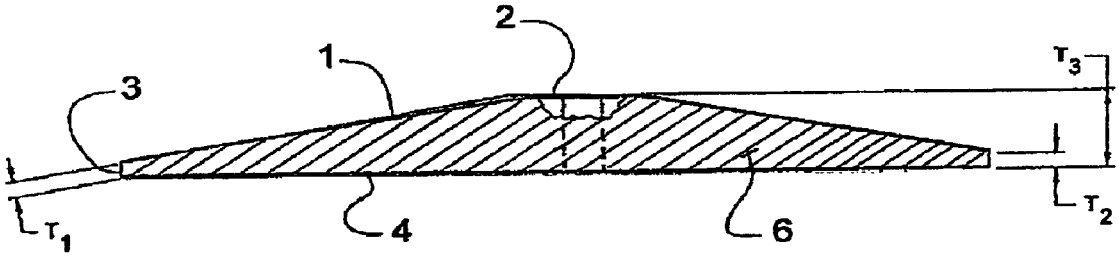
FIG. 6 is a vertical cross section of the entire width of one embodiment of the present invention.
Figure 7:
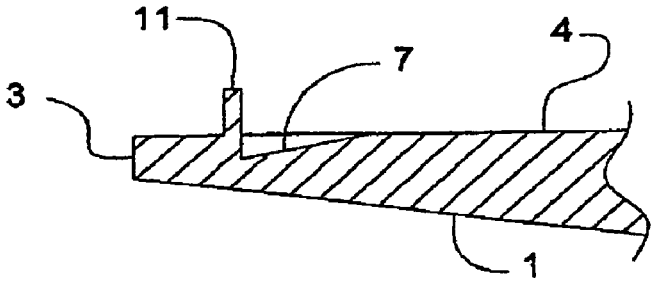
FIG. 7 is a partial vertical cross section showing a lip and an indentation of one embodiment of the present invention.

As shown in FIG. 6, the thickness "$T_1$" of the top portion 1 is substantially the same from the center of the golf tee height stopper A to the edge 3, while the overall height of the golf tee height stopper A varies from a smaller thickness at "$T_2$" to larger thickness at "$T_3$." Thus, while there is a slope to the top portion 1, the bottom surface 4 of the golf tee height stopper A is substantially flat. As a result, the vertical thickness of each of the plurality of spokes 6 can vary between the smaller thickness of the plurality of spokes at the edge 3 and the larger thickness of the plurality of spokes near the axial center of the golf tee height stopper A. In a preferred embodiment the thickness $T_2$ is about 1/16 inch and the thickness $T_3$ is about ⅛ inch. These thicknesses can be adjusted as necessary to fit the material used to make the golf tee height stopper A and to match the intended application of the golf tee height stopper A to its intended use.

The golf tee height stopper in the present embodiment includes an indentation 7 (FIG. 2 and FIG. 3) disposed on the bottom surface 4 of the golf tee height stopper A. The indentation 7 provides a configuration and shape that can permit the general placement of a standard golf tee into the indentation such that a head of the standard golf tee can reside in the indentation while a shaft of the standard golf tee can rest on the bottom surface 4 of the golf tee height stopper A. The indentation 7 includes a lip 11 that extends above the bottom surface 4 of the golf tee height stopper A. In this embodiment, the lip 11 can act as a stop against which the head of the standard golf tee can be placed.

The preferred embodiment of the golf tee height stopper also includes calibration markings on the bottom surface 4 of the golf tee height stopper A. Depending on the embodiment of the present invention, the calibration markings can include a set of linear marking indicia 9, a set of sequential marking indicia 10, or both. The set of linear marking indicia 9 in the preferred embodiment generally comprises a plurality of raised lines that are spaced apart and that are generally perpendicular to the longitudinal axis of the golf tee when the tee is residing within the indentation 7. It is noted that in one embodiment of the present invention, the set of linear marking indicia 9 comprises two columns of raised linear marks with a gap between each of the two columns of raised linear marks. The two columns of raised linear marks are also substantially adjacent to the axial centerline of the golf tee height stopper A. It is appreciated that while two columns of linear marks are used in some embodiments of the present invention, other embodiments may have only one column of linear marks and still remain within the scope of the present invention. It is also understood that in other embodiments of the present invention, the linear marks are not raised.

The indentation 7 is generally disposed on the axial centerline of the golf tee height stopper A at a point at one end of the two columns of the raised linear marks. It is understood that when the set of linear marking indicia 9 comprises two columns of raised linear marks with a gap between the two columns, the orientation of the indentation 7 and the gap between the two columns of linear marks acts to assist in the longitudinal alignment of the golf tee that has been placed on the bottom surface 4 because the inward ends of the two columns of raised linear marks tend to keep the longitudinal axis of the shaft of the golf tee in general alignment with the indentation 7 that is located at about the axial centerline of the golf tee height stopper A.

The set of sequential marking indicia 10 of the present embodiment are disposed substantially between the individual lines of the set of linear marking indicia 9, and the set of sequential marking indicia can include a series of numbers or letters that ascend or descend in a specific order. In other embodiments, the set of sequential marking indicia 10 can located on other surfaces of the golf tee height stopper as long as the placement of the set of sequential marking indicia can be used to mark a golf tee as described herein.

The user refers to the mark placed upon the marked golf tee that indicated the height of the tee as preferred by the user and then determines which one of the either the set of linear marking indicia 9 or the set of sequential marking indicia 10 are most aligned with the mark placed upon the marked golf tee. Once the user determines which individual marking indicia best aligns with the mark on the marked golf tee, the user can note that marking indicia for use to mark any unmarked golf tees the user may wish to use in future games of golf.

Operation

The manner of using the golf tee height stopper A is as follows. Referring now to FIG. 1, the initial setup of one embodiment of the present invention requires a user to insert a standard golf tee (not shown) into the aperture 2 of the golf tee height stopper A. The user then slides or rotates the golf tee height stopper A, to a point close to where the user wishes the standard golf tee to stop when teeing a golf ball on the golf tee.

The user inserts the golf tee into the ground by pinching the golf tee between the user's thumb and index finger at the point directly above the golf tee height stopper A and inserts the golf tee into the ground until the golf tee height stopper A contacts the ground. This insertion can be done while the golf ball is disposed on the head of the golf tee, or the golf ball can be placed on the head of the golf tee after the golf tee has been inserted into the ground. If the golf tee height stopper A contacts the ground before the golf ball reaches the desired height, the user pushes downward on the golf tee until the head of the golf tee reaches the user's desired height for the golf tee to hold the golf ball.

It is understood that during typical use the golf tee height stopper A will stop when it contacts the ground. If the desired golf ball height is achieved and the golf tee height stopper A has not yet contacted the ground, the user may slide or rotate the golf tee height stopper A to reposition the golf tee height stopper downward on the golf tee down the golf tee until the golf tee height stopper is in contact with the ground while the golf tee remains at the desired height. This final adjusted position is a signal to the user that generally indicates the positional relationship between the golf tee height stopper A and the golf ball as needed to result in the insertion of the golf tee into the ground at a height that will place the golf ball at the height desired by the user.

It will be appreciated that once the proper positional relationship between the golf tee height stopper A and the golf tee is determined, the user may take actions necessary to identify this proper positional relationship to ensure that when a different golf tee, or the same golf tee if the golf tee height stopper A is somehow dislocated, is inserted into the golf tee height stopper, the same positional relationship between the golf tee height stopper A and the golf tee can be retained. More specifically, the proper positional relationship between the golf tee height stopper A and the golf tee can be identified for future use by removing the assembled golf tee height stopper A and golf tee from the ground, without disturbing the positional relationship between the golf tee height stopper and the golf tee, and then marking the longitudinal location of the golf tee height stopper on the shaft of the golf tee with an appropriate marking device. This mark allows the user to relocate the golf tee height stopper A should the positional relationship between the golf tee height stopper and the golf tee is disturbed.

Once an initial golf tee is properly marked as described above, the user may place the golf tee into indentation 7 by placing the head of the golf tee against the lip 11 and resting the remainder of the golf tee within the two columns of linear marks that comprise the set of linear indicia 9. After the marked golf tee has been placed into the indentation 7, the user can correlate the marked placed upon the golf tee with the calibration markings as noted above that are disposed on the bottom surface 4 of the golf tee height stopper A. The user refers to the mark placed upon the marked golf tee and determines which one of the either the set of linear marking indicia 9 or the set of sequential marking indicia 10 are most aligned with the mark placed upon the marked golf tee. Once the user determines which individual marking indicia best aligns with the mark on the marked golf tee, the user can record that marking indicia for use to mark any unmarked golf tees the user may wish to use in future games of golf.

To mark an unmarked golf tee using the marking indicia of the preferred embodiment of the golf tee height stopper A, the user places an unmarked golf tee into the indentation 7 while ensuring the head of the golf tee is disposed against the lip 11 and that the longitudinal axis of the shaft of golf tee is disposed between the two columns of linear marks of the set of linear marking indicia 9. The user then recalls the specific individual marking indicia that was noted above that was determined by the user to coincide with the mark that resulted in the best height of the golf ball on the golf tee. The user then marks the unmarked golf tee by placing a mark on the shaft of the unmarked golf tee that matches the noted indicia for the best golf tee height. This process that can then be repeated by the user to mark any other unmarked golf tees to ensure that the golf tees can repeatedly position a golf ball at generally the predetermined height above the ground that best fits the desires of the user.

Additionally, as golf tees are sometimes manufactured with calibration marks preprinted on shafts of the golf tees, the user can identify which of the preprinted calibration marks on the golf tee correlate to the user's preferred ball height as determined above.

While the above description describes various embodiments of the present invention, it will be clear that the present invention may be otherwise easily adapted to fit any configuration where a device to control the height of a golf tee is required. Additionally, as various changes could be made in the above constructions without departing from the scope of the invention, it is also intended that all matter contained in the above description or shown in the accompanying drawings shall be interpreted as illustrative and not in a limiting sense. The scope of the invention should be determined by the appended claims and their legal equivalents, rather than by the examples given.

What is claimed is:

1. A golf tee placement device comprising:

a golf tee height stopper having an aperture that is sized and configured to slideably communicate with a standard golf tee to thereby install the golf tee in the golf tee height stopper at a preferred position for installation of the golf tee into a surface, wherein the golf tee height stopper includes a top portion that is generally circular in shape having a diameter that is between about 2 inches and about 2⅛ inches, wherein the top portion has a thickness that is substantially the same from the center of the golf tee height stopper to its edge, wherein an overall height of the golf tee height stopper varies from a smaller thickness at its edge to a larger thickness at the center of the golf tee placement device such that the smaller thickness is about 1/16 inch and the larger thickness is about ⅛ inch, and wherein the golf tee height stopper is made from a resilient material that is one of either an elastomeric polymer, a urethane, or a rubber;

an aperture that is substantially in the shape of one of either a square having a dimension of about 0.09 inches between the adjacent corners of the square wherein the sides of the square are arcuately shaped toward the center of the square, a polygon, a triangle, a circle, an ellipse, a symmetric geometric shape, or an asymmetric shape, wherein the aperture is located at about the center of the golf tee height stopper, an edge;

a bottom surface;

a plurality of spokes that generally radiate from the center of the golf tee height stopper to its edge wherein the thickness of each of the plurality of spokes is greater at the center of the golf tee height stopper than at the edge, and wherein a bottom surface of each of the plurality of spokes is substantially flat and substantially perpendicular to the edge;

an indentation;

a set of linear marking indicia; and a set of sequential marking indicia wherein the indentation, the set of linear marking indicia, and the set of sequential marking indicia are disposed on the bottom surface of the golf tee height stopper.

2. The golf tee placement device of claim 1 wherein the indentation provides a configuration that permits the general placement of a standard golf tee onto the indentation such that a head of the standard golf tee can reside in the indentation.

3. The golf tee placement device of claim 2 wherein the indentation includes a lip that extends above the bottom surface of the golf tee height stopper such that the lip can act as a stop against which the head of the standard golf tee can be placed and wherein the set of linear marking indicia comprises a plurality of raised linear marks arranged in two columns that are substantially adjacent to the axial centerline of the golf placement device and in substantial axial alignment with the longitudinal centerline of the indentation.

4. The golf tee placement device of claim 3 wherein a mark can be added to the shaft of the standard golf tee residing in the indentation wherein the mark correlates to at least one of either one of the set of linear marking indicia or one of the set of sequential marking indicia.

5. The golf tee placement device of claim 4 wherein the mark placed on the shaft of the standard golf tee correlates to a height of a golf ball.

6. A golf tee placement device comprising:

a golf tee height stopper that is made from a resilient material and has an aperture that is sized and configured to slideably communicate with a standard golf tee to thereby install the golf tee in the golf tee height stopper at a preferred position for installation of the golf tee into a surface, wherein an overall height of the golf tee height stopper varies from a smaller thickness of about 0.06 inch at the edge to a larger thickness of about 0.13 inch at the center of the golf tee height stopper, and wherein the golf tee height stopper includes;

a top portion that is generally circular in shape having a diameter that is between about 2 inches and about 2⅛ inches;

an aperture that is located at about the center of the golf tee height stopper and that is substantially in the shape of one of either a polygon, a triangle, a circle, an ellipse, a symmetric geometric shape, an asymmetric shape, or a square having a dimension of about 0.09 inches between the adjacent corners of the square and wherein the sides of the square are arcuately shaped toward the center of the square;

an edge;

a bottom surface that is substantially flat and substantially perpendicular to the edge;

a plurality of spokes that generally radiate from the center of the golf tee height stopper to the edge wherein the thickness of each of the plurality of spokes is greater at the center of the golf tee height stopper than at the edge;

an indentation;

at least one of a set of linear marking indicia and a set of sequential marking indicia wherein the indentation, the at least one set of linear marking indicia and the set of sequential marking indicia are disposed on the bottom surface of the golf tee height stopper.

* * * * *